US007344303B2

(12) United States Patent
Conus et al.

(10) Patent No.: US 7,344,303 B2
(45) Date of Patent: Mar. 18, 2008

(54) SHOCK ABSORBER BEARING FOR A TIMEPIECE

(75) Inventors: Thierry Conus, Lengnau (CH); Jean-Luc Helfer, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 46 days.

(21) Appl. No.: 11/276,302

(22) Filed: Feb. 23, 2006

(65) Prior Publication Data

US 2006/0187767 A1 Aug. 24, 2006

(30) Foreign Application Priority Data

Feb. 23, 2005 (EP) ..... 05003868

(51) Int. Cl.
*G04B 31/00* (2006.01)

(52) U.S. Cl. ..... 368/324; 368/326

(58) Field of Classification Search ..... 368/322, 368/324–326, 127

See application file for complete search history.

(56) References Cited

U.S. PATENT DOCUMENTS

| | | | | | |
|---|---|---|---|---|---|
| 2,489,552 | A * | 11/1949 | Widmer-Steiner | ..... | 368/326 |
| 2,700,273 | A * | 1/1955 | Godat | ..... | 368/326 |
| 2,938,328 | A * | 5/1960 | Derr et al. | ..... | 368/326 |
| 3,104,518 | A * | 9/1963 | Christen | ..... | 368/326 |
| 3,146,582 | A * | 9/1964 | Loretan | ..... | 368/326 |
| 3,306,028 | A * | 2/1967 | Suzuki | ..... | 368/326 |
| 3,478,510 | A * | 11/1969 | Fritz | ..... | 368/324 |
| 3,500,632 | A * | 3/1970 | Fritz | ..... | 368/326 |
| 3,712,051 | A * | 1/1973 | Romang et al. | ..... | 368/326 |
| 4,217,753 | A * | 8/1980 | Loretan | ..... | 368/324 |
| 2006/0215499 | A1 * | 9/2006 | Kohler et al. | ..... | 368/324 |

FOREIGN PATENT DOCUMENTS

| | | |
|---|---|---|
| CH | 237 812 | 5/1945 |
| CH | 285 200 | 8/1952 |
| CH | 296 070 | 1/1954 |
| CH | 340 784 | 8/1959 |
| CH | 390 804 | 12/1964 |
| CH | 577 202 | 6/1976 |
| DE | 76 01 537 U1 | 5/1976 |
| FR | 1 532 798 | 7/1968 |
| FR | 2 307 175 | 11/1976 |

* cited by examiner

*Primary Examiner*—Gary F. Paumen
(74) *Attorney, Agent, or Firm*—Sughrue Mion, PLLC

(57) ABSTRACT

The housing (6) of the bearing block (1), locks the peripheral ring (11) of a spring (10) with axial and radial deformation further comprising a substantially annular rigid central support (13) which cooperates with a cap (23), fitted by means of lugs (25) to the outside of the central support (13), to hold the pierced stone (4) and the endstone (5). The resilient part (12) of the spring (10) is for example formed of bent arms.

15 Claims, 3 Drawing Sheets

SHOCK ABSORBER BEARING FOR A TIMEPIECE

This application claims priority from European Patent Application No. 05003868.6 filed Feb. 23, 2005, the entire disclosure of which is incorporated herein by reference

FIELD OF THE INVENTION

The present invention concerns a shock absorber bearing for a timepiece, and more particularly, the balance staff bearing of a mechanical watch, for preventing the pivot of small diameter, located at its end and designated the "pivot-shank" from breaking, in the event of an axial or lateral shock, that could simply result from an abrupt movement of the user's wrist.

BACKGROUND OF THE INVENTION

Mechanical watch designers have for a long time devised numerous devices for absorbing the energy resulting from a shock, particularly a lateral shock, by the balance staff abutting against a wall of the hole in the base block through which it passes, while allowing a momentary movement of the pivot-shank before it is returned to its rest position via the action of a spring.

FIGS. 1 and 2 illustrate a device, called a "reverse double cone", which is currently used in timepieces on the market. A device of this type is for example disclosed in FR Patent No. 1 532 798.

A support block 1, whose base comprises a hole 2 for the passage of balance staff 3 ending in a pivot-shank 3*a*, allows the positioning of a setting 20 in which a pierced stone 4, through which the pivot-shank 3*a* passes, and an endstone 5 are stopped. Setting 20 is held in a recess 6 of support block 1 by a spring 10, which in this example includes radial extensions 9 compressing endstone 5. Recess 6 comprises two shoulders 7, 7*a* in the shape of inverted cones which support complementary shoulders 8, 8*a* of setting 20, said shoulders having to be made with a very high level of precision. In the event of an axial shock, spring 10 acts alone to return balance staff 3 to its initial position. In the event of a lateral shock, i.e. when the end of the pivot-shank unbalances setting 20 outside its rest plane, spring 10 cooperates with the complementary inclined planes 7, 7*a*; 8, 8*a* to centre setting 20 again.

In this construction it is very difficult to adjust the compression force of spring 10 and the optimum angle of the complementary inclined planes 7, 7*a*; 8, 8*a* at the same time, taking account also of the friction coefficient between said inclined planes, such that re-centring errors can occur after a lateral shock. This obviously has the drawback of adversely affecting the chronometric qualities of the timepiece.

Shock absorber devices that do not include a setting and thus without any of the aforementioned problems of friction, have also been proposed in the past. CH Patent No. 237 812 for example, discloses a device comprising a pierced stone secured to a first resilient device clamped in the block by means of a slit ring and an endstone held by a second resilient device formed by a star-spring. The presence of the two springs making the two stones move separately raises re-centring problems in the event of a shock and problems of lubrication. In CH Patent No. 577 202, the two stones are also suspended between two washers comprising diverging radial resilient strips respectively abutting on the endstone and on the pierced stone, the two stones being separated by a separating washer, which also raises re-centring problems because of friction between the stones and the resilient strips.

SUMMARY OF THE INVENTION

It is thus an object of the present invention to overcome the aforecited drawbacks of the prior art by providing a shock absorber bearing comprising a pierced stone and an endstone assembled in a setting suspended by a single spring, i.e. removing any friction capable of causing re-centring problems, while allowing broader manufacturing tolerances as regards dimensions, given that there are no longer any inclined planes.

The invention therefore concerns a shock absorber bearing for the pivot of an arbour of a moving part in a small portable apparatus, and particularly the pivot shank of a timepiece arbour. The bearing is formed of a support block to be driven into, fixed or formed in an element of the timepiece frame. The support block is provided with a recess for a spring with radial and axial deformation and a setting carrying a pierced stone and an endstone. The bearing is characterized in that the spring is formed of a peripheral ring driven into the housing and connected via resilient means to a substantially annular rigid central support and in that the setting is suspended at the centre of the spring, said setting allowing the relative position of the two stones to be definitively and removably fixed.

According to the simplest embodiment, the pierced stone and the endstone are driven into the aperture of the central support forming the setting.

According to a preferred embodiment, the setting is made up of two parts, one being formed by the rigid central support whose inner wall holds the pierced stone, the other being formed by a cap secured in an irremovable manner to the rigid central support to lock the endstone against the upper shoulder of the central support.

As can be seen, the recess and the setting, in particular the part forming the cap, have simple shapes that are easy to make with ordinary tolerance requirements for the dimensions, i.e. advantageously as regards manufacturing costs. Since the setting cannot be dismantled, it is advantageous to provide through passages for carrying out a cleaning operation before lubricating the space comprised between the pierced stone and the endstone, as occurs periodically when the timepiece is serviced.

The resilient means of the spring are for example formed of bent resilient arms that connect the peripheral ring and the central support. These resilient means could have a quite different configuration provided they return the setting to its precise rest position after an axial or radial shock. They can be made of any material having the desired resilient properties, such as a metal, an alloy or a plastic material.

BRIEF DESCRIPTION OF THE DRAWINGS

Other features and advantages of the present invention will appear more clearly in the following description of an example embodiment given by way of non-limiting illustration with reference to the annexed drawings, in which.

DETAILED DESCRIPTION OF THE INVENTION

Figure 1:
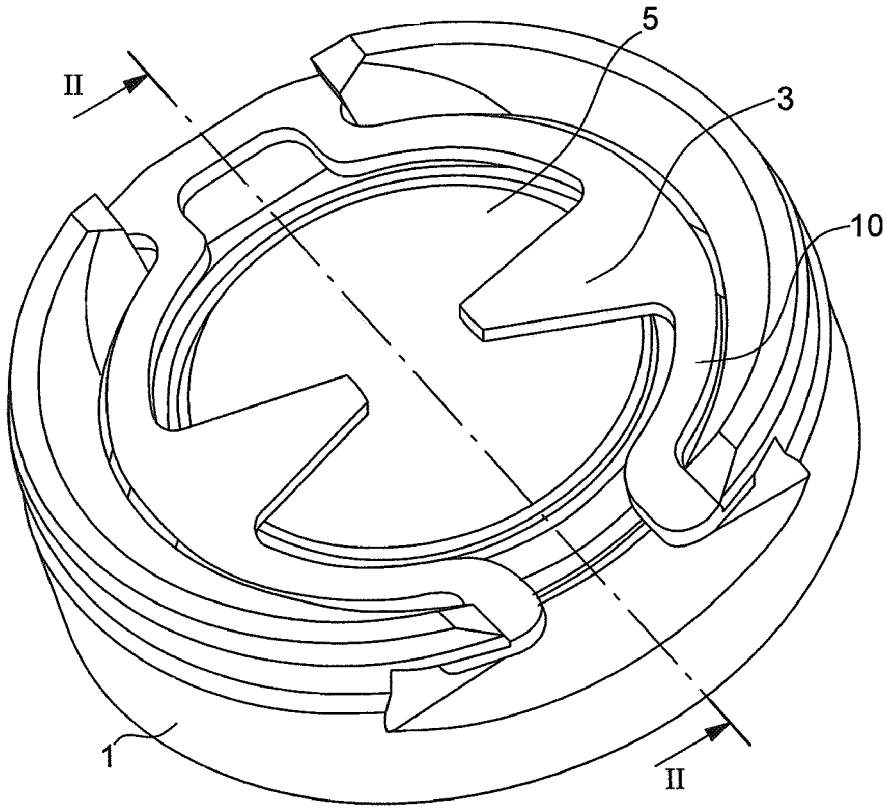
Fig. 1 (prior art)
FIG. 1 shows, in perspective, a shock absorber bearing according to the prior art.
Figure 2:
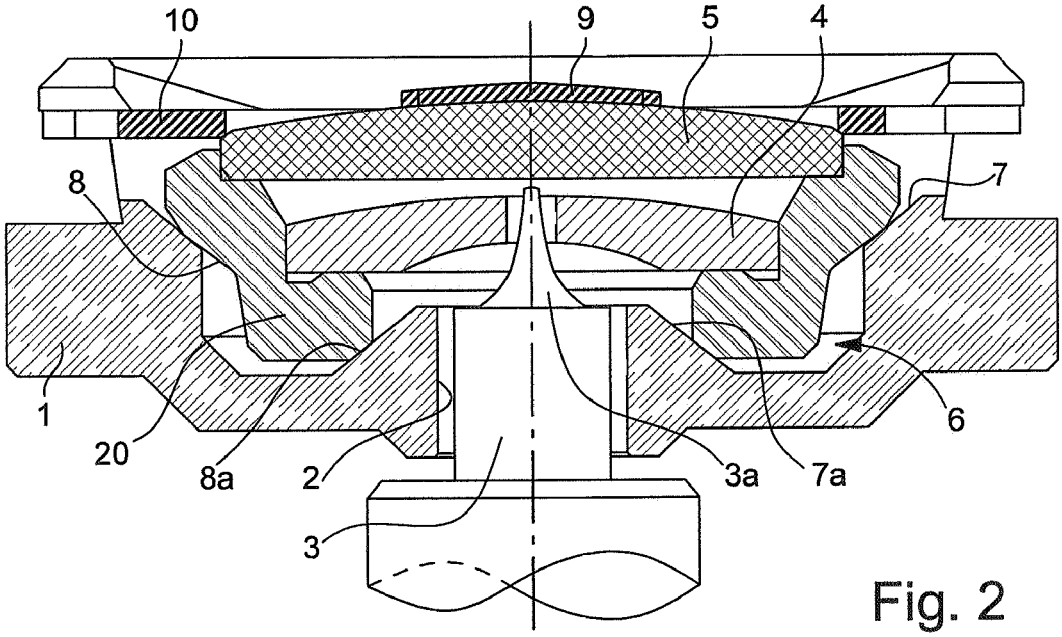
Fig. 2 (prior art)
FIG. 2 shows a cross-section along the line II-II of FIG. 1.
Figure 3:
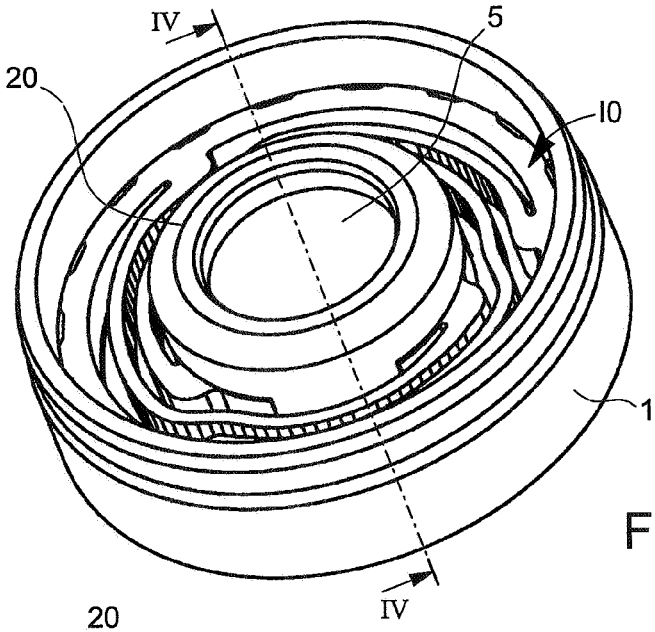
FIG. 3 shows, in perspective, a shock absorber bearing according to the invention.
Figure 4:
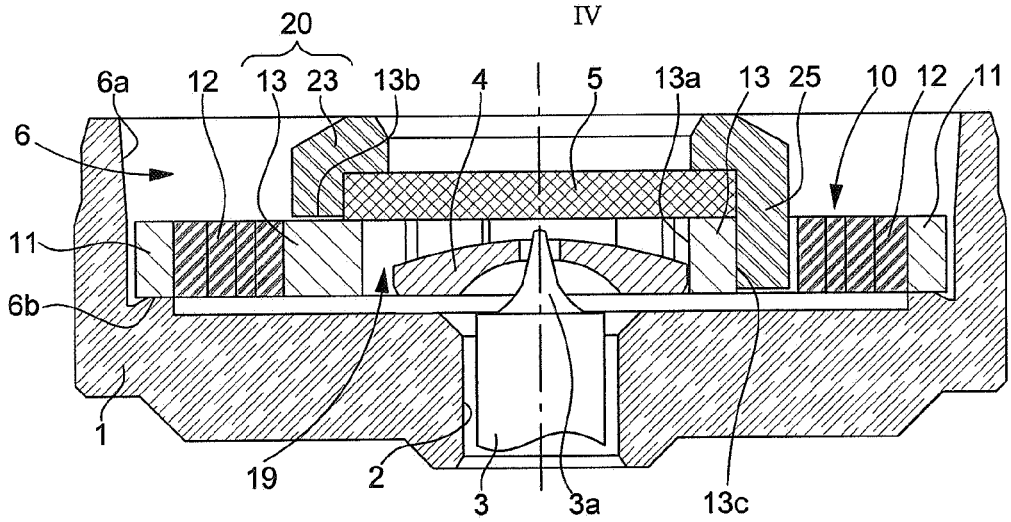
FIG. 4 shows a cross-section along the line IV-IV of FIG. 3.

Referring essentially to FIGS. 3 and 4, a shock absorber bearing according to the invention, for preventing the pivot-shank of a timepiece balance-staff from breaking or being moved off-centre, will be described hereinafter. Those construction elements that are identical or similar to those of the prior art illustrated in the preamble by FIGS. 1 and 2 will be designated by the same references.

The bearing includes a support block 1 of circular shape delimiting a recess 6 whose centre is pierced with a hole 2 to allowing passage of a balance-staff 3 ending in a pivot-shank 3*a*.

The support block 1 can be either an independent piece driven or fixed by any other means in the frame of the watch movement, or it can form part of another piece of the movement, such as a bridge or plate.

Figure 7:
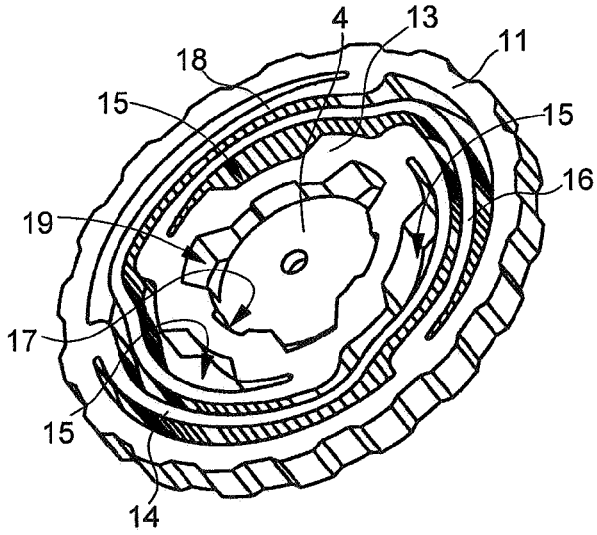
FIG. 7 shows, in perspective, the spring of a bearing according to the invention.
Figure 8:
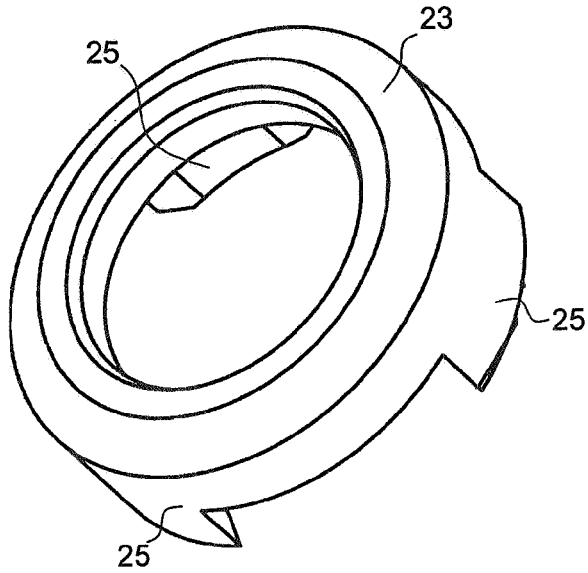
FIG. 8 shows, in perspective, one of the elements forming the setting.

As can be seen, selling 20 which carries the pierced stone 4 through which pivot-shank 3*a* passes, and endstone 5, is in a way, suspended in recess 6 by spring 10. Spring 10, shown in perspective in FIG. 7, is formed of three parts. A first part is formed of a peripheral scalloped rigid ring 11, which is forcibly mounted against the wall 6*a* of recess 6 abutting on a rim 6*b* located at the bottom of recess 6 so as to arrange a space allowing some axial play for spring 10. The second part is formed of a rigid central support 13 of generally annular shape. As can be seen in FIG. 7, pierced stone 4 is driven into the aperture of support 13 whose inner wall 13*a* includes a certain number of recesses 17 whose purpose is essentially to provide a certain resilience allowing pierced stone 4 to be driven in in a non-destructive manner. The third part of spring 10 is formed of resilient means 12 joining peripheral ring 11 and central support 13, said resilient means 12 being chosen to have a reactive force both along the balance-staff and perpendicular thereto. In the example shown in FIG. 5, it can be seen that these resilient means are formed of three bent arms 14, 16, 18 whose points of attachment, respectively to peripheral ring 11 and to central support 13, are shifted angularly by 120°. It is of course clear that the resilient function could be achieved with a different number of arms, or with other shapes.

Figure 6:
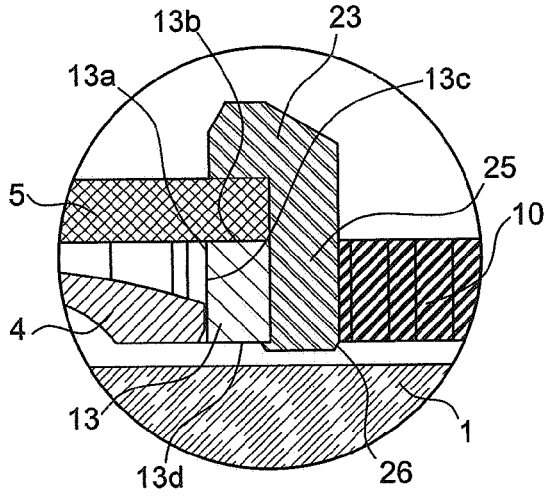
FIG. 6 is an enlarged partial diagram of an alternative assembly of the bearing of FIG. 4.

Referring also to FIG. 6, it can be seen that setting 20 is formed of two parts. A first part, in a way integrated in spring 10, is formed of the central support 13 carrying pierced stone 4, as described hereinbefore. A second part is formed of a cap 23 which is fitted onto central support 13 to immobilise endstone 5 on the upper shoulder 13*b*. In the example shown, cap 23 is fitted by means of lugs 25 extending along the outer wall 13*c* of central support 13, through recesses portions 15 provided in said wall 13*c* between the points of attachment of arms 14, 16, 18. Zones 27, where cap 23 has no lugs 25, abuts on upper shoulder 13*b* of central support 13. In order to secure the fitting of cap 23 onto central support 13, bonding, welding or riveting could also be carried out.

One could also, as shown in the partial view of FIG. 6, provide a small extension or rib 16 at the base of lugs 25 that snap fits under the lower part 13*d* of central support 13.

The shock absorber bearings of the prior art enable the setting to be dismantled by removing the spring, then the endstone for the periodic cleaning of the space comprised between the two stones before further lubrication. As the bearing according to the invention cannot be dismantled, hollows 19 are provided for carrying out such cleaning during a service, by circulating a cleaning fluid between the hole of pierced stone 4 and said recesses 19 before carrying out further lubrication.

In order to obtain rapid absorption of the oscillations of setting 20 after a shock, it is advantageous to insert, between the free parts of the spring, which in this example are the arms 14, 16, 18, a material or substance that absorbs vibrations, such as an elastomer or an oil with some viscosity.

Figure 5:
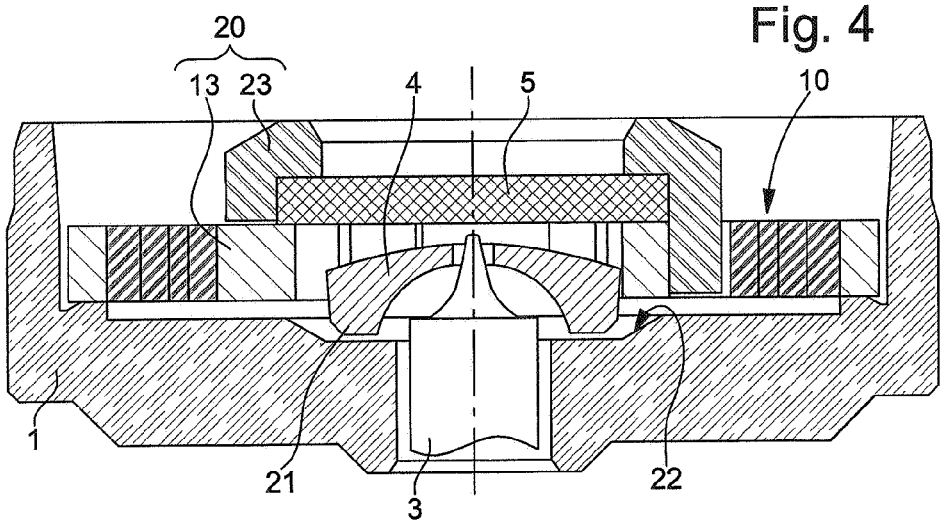
FIG. 5 is a variant of the bearing shown in cross-section in FIG. 4.

In the event of relatively violent shocks, and in order to absorb oscillations more quickly, the base of block 1 can comprise a conical cup 22, as shown in FIG. 5, on the walls of which a constituent element of setting 20, such as the lugs or central support 13, or even the base of pierced stone 4, as shown in this example, can slide.

The preceding description was made with reference to an embodiment wherein setting 20 is made in two parts. In a simplified embodiment, which can easily be understood without the necessity of referring to the Figures, pierced stone 4 and endstone 5 can both be set or driven into the inside of wall 13*a* of rigid central support 13, provided of course the height of said wall is sufficient, which generally means higher than the height of the rest of spring 10. Without departing from the scope of the invention, those skilled in the art can devise other variants, for example in the simplified embodiment, locking endstone 5 by means of a disc forming a cover or a cap with no lugs.

The materials used for block 1 and for stones 4, 5 are well known to those skilled in the art and thus do not require description in order to understand the invention. Spring 10 can be made either of metal or an alloy, or of silicon, or an elastomeric plastic material.

When the spring is made of metal, an alloy or silicon, its contour can be made for example by wire spark machining techniques, etching, or by photolithography and galvanic growth. In the case of a plastic material, injection-moulding techniques will, for example, be used.

What is claimed is:

1. A shock absorber bearing for a pivot-shank of an arbour of a moving part of a timepiece including a support block to be driven in, fixed or formed in the frame of said timepiece, said support block being provided with a recess provided for receiving a spring with axial and radial deformation and a setting carrying a pierced stone through which the pivot-shank passes and an endstone, wherein the spring is formed in a single piece of a rigid peripheral ring driven into the housing, with a substantially annular rigid central support and of resilient means connecting said rigid elements and in that the setting holding the two stones is suspended at the centre of the spring.

2. The shock absorber bearing according to claim 1, wherein the setting is merged with the aperture of the central support of the spring.

3. The shock absorber bearing according to claim 1, wherein the setting is formed of two parts, one being formed of the rigid central support whose inner wall holds the pierced stone, the other being formed of a cap secured to said rigid central support to lock the endstone onto the upper shoulder of the central support.

4. The shock absorber bearing according to claim 3, wherein the cap includes lugs that are housed in complementary recessed portions of the outer wall of the central support.

5. The shock absorber bearing according to claim 4, wherein the lugs of the cap are bonded, welded or riveted against the outer wall of the central support.

6. The shock absorber bearing according to claim 3, wherein the cap includes lugs that are housed in complementary recessed portions of the outer wall of the central support, said lugs extending beyond the lower surface of the central support and being prolonged inwards by a rib that is fitted under said lower surface.

7. The shock absorber bearing according to claim 1, wherein the resilient means of the spring are formed of bent arms connecting the peripheral ring and the central support.

8. The shock absorber bearing according to claim 7, wherein the bent arms, the peripheral ring and the central support of the spring are made of a metal or alloy.

9. The shock absorber bearing according to claim 8, wherein the spaces comprised between the arms are provided with a material or substance that absorbs vibrations.

10. The shock absorber bearing according to claim 1, wherein the spring is made of an elastomeric plastic material.

11. The shock absorber bearing according to claim 1, wherein the inner wall of the central support includes hollows enabling the space comprised between the pierced stone and the endstone to be cleaned.

12. The shock absorber bearing according to claim 1, wherein the base of the block further includes a conical cup along the balance-staff and in that a constituent element of the setting or of the pierced stone includes an extension extending into said cup and absorbing large travels of the pierced stone in the event of violent shocks.

13. A method of manufacturing a shock absorber bearing according to claim 8, wherein the spring is manufactured by wire spark machining techniques, masking and electroshaping or etching.

14. The method of manufacturing a shock absorber bearing according to claim 10, wherein the spring is manufactured by injection moulding.

15. Shock absorber bearing according to claim 1, wherein the resilient means, the peripheral ring and the central support of the spring are made of silicon.

* * * * *